US008702438B2

(12) United States Patent
Frank

(10) Patent No.: US 8,702,438 B2
(45) Date of Patent: Apr. 22, 2014

(54) ELECTRICAL PLUG CONNECTION ELEMENT

(75) Inventor: Erich Frank, Hochdorf (DE)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/261,521

(22) PCT Filed: Jun. 6, 2011

(86) PCT No.: PCT/EP2011/002755
§ 371 (c)(1),
(2), (4) Date: Nov. 20, 2012

(87) PCT Pub. No.: WO2011/154116
PCT Pub. Date: Dec. 15, 2011

(65) Prior Publication Data

US 2013/0065458 A1 Mar. 14, 2013

(30) Foreign Application Priority Data

Jun. 9, 2010 (DE) ..... 10 2010 023 841

(51) Int. Cl.
*H01R 11/22* (2006.01)

(52) U.S. Cl.
USPC ..... 439/268; 439/843

(58) Field of Classification Search
USPC ..... 439/159, 268, 834, 843, 851, 923
See application file for complete search history.

(56) References Cited

U.S. PATENT DOCUMENTS

| | | | | |
|---|---|---|---|---|
| 4,591,222 | A | 5/1986 | Shaffer | |
| 4,655,526 | A | 4/1987 | Shaffer | |
| 6,257,911 | B1 | 7/2001 | Shelby et al. | |
| 7,291,033 | B2 * | 11/2007 | Hu | 439/347 |
| 2003/0109181 | A1 | 6/2003 | Bungo | |

FOREIGN PATENT DOCUMENTS

| | | | |
|---|---|---|---|
| DE | 17 90 315 | | 8/1975 |
| DE | 10 2005 043 694 | A1 | 3/2007 |
| DE | 10 2006 009074 | | 8/2007 |
| DE | 20 2008 013812 | | 3/2009 |
| DE | 10 2008 007 866 | A1 | 8/2009 |
| EP | 1 191 637 | A1 | 3/2002 |

* cited by examiner

*Primary Examiner* — Khiem Nguyen
(74) *Attorney, Agent, or Firm* — Gregg H. Rosenblatt

(57) ABSTRACT

The invention relates to an electrical plug connection element (1) having a contact member (16) which can be deformed in a spring-elastic manner and to which the plug connection element (1) can be electrically connected when it is plug-connected to a further plug connection element (2), characterized in that the plug connection element (1) has a clamping element (40) by means of which the contact member (16) and/or a separate spring (20) which supports the contact member (16) when contact is made can be deformed in a spring-elastic manner in such a way that the force which is required to plug-connect the plug connection element (1) to the further plug connection element (2) is reduced, and in that the action of the clamping element (40) can be removed by the plug connection element (1) being plug-connected to the further plug connection element (2), and as a result the contact member (16) can be brought into contact with the further plug connection element (2) so as to establish an electrical connection by way of the provided contact force.

11 Claims, 3 Drawing Sheets

ELECTRICAL PLUG CONNECTION ELEMENT

Figure 1:
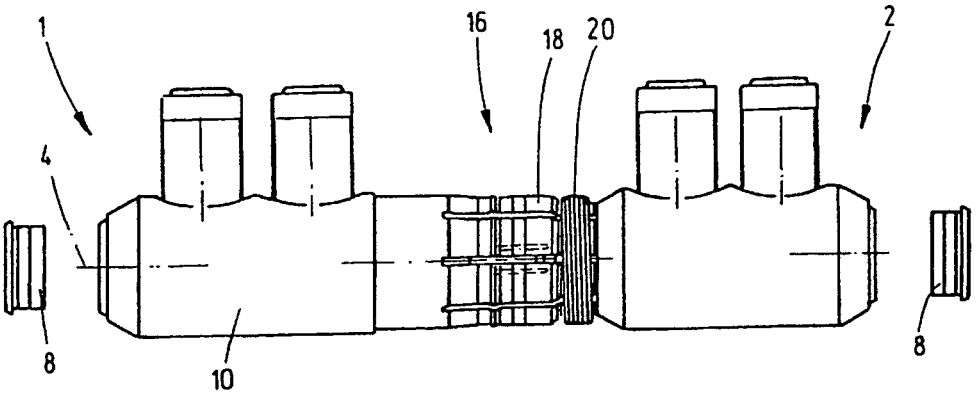

The invention relates to an electrical plug connection element having an elastically deformable contact member by means of which the plug connection element can be electrically connected when mated with an associated further plug connection element.

Such plug connection elements are known, for example, from DE 10 2007 042 914 A1. When the plug connection element is mated with an associated further plug connection element, the contact member must optionally also be bent up against the action of a separate spring, as a result of which an increased insertion force is necessary during mating. For many applications, this is not disadvantageous or is even desirable because in this way during mating it is indicated to the operator that at this point the contact member is making contact.

In applications in which the force which can be applied during mating is limited, for example, because the plug connection element is located at a poorly accessible location, it is necessary to compromise between the insertion force which is to applied and the contact force which is active in the mated state.

DE 10 2005 043 694 A1 discloses an electrical plug-in connector with pretensioned contact laminations which extend from a base body opposite the insertion direction of a contact pin. The plug-in connector moreover has an elastic spreading element which is supported in the initial state against a displacement in the insertion direction of the contact pin by at least one latch and keeps the contact laminations in an elastically tensioned open position, with at least one latch being detachable by inserting the contact pin beyond the point of the contact with the spreading element. The spreading element is essentially an elastically deformable plate which is anchored in associated latches on the inside surfaces of the contact laminations.

U.S. Pat. No. 4,951,222 and U.S. Pat. No. 6,275,911 show electrical plug-in connectors with a reduced insertion force.

DE 10 2006 009 074 A1 shows an electrical plug-in connector with pretensioned contact lamination whose free end is pointed in the insertion direction of the contact pin, and with a retaining arm which is pivot-mounted on a plug-in connector housing and which, in the insertion-ready initial state of the plug-in connector, projects both into the plug receiver with its free end and also holds back the contact lamination which has been pretensioned into the plug receiver.

EP 1 191 637 A1 shows a plug-in connector with a pin-like projection on a plug part which can be plugged into a socket of a socket part. The pin-like projection has a groove which is made essentially transverse to its longitudinal extension. The socket has a latching means which at least partially extends transversely to its longitudinal direction into the interior of the socket. In the connected state of the plug part with the socket part, the latch means engages the groove.

DE 10 2008 007 866 A1 shows a so-called banana plug to which a connecting cable can be connected by means of a clamping screw.

The object of the invention is to provide an electrical plug connection element which has performance characteristics which have been further improved. In one embodiment, the insertion force which is necessary in the mating of the plug connection element with another plug connection element is to be reduced and yet a permanently reliable electrical connection is to be ensured.

This object is achieved by the plug connection element defined in claim 1. Special embodiments of the invention are defined in the dependent claims.

In one embodiment, the plug connection element has a clamping element by means of which the contact member and/or a separate spring which supports the contact member when contact is made can be elastically deformed, especially is deformed in the initial state of the plug connection element before mating, such that the force necessary when the plug connection element is mated with the further plug connection element is reduced compared to the amount of force which is necessary without the clamping element. This reduced force applies to one stage of the mating, especially at the start of mating. As mating continues, especially in the course of complete mating, the action of the clamping element can be automatically canceled and permanently forced by the mating. As a result, the contact member can be brought into electrically connecting contact with the further plug connection element with the provided contact force which is defined by the inherent resilience of the contact member, optionally added to a force which has been applied by a separate spring.

In this way, the insertion force which is necessary for the mating of the plug connection element with the further plug connection element is reduced, especially at the start of mating. At the same time, in the completely mated state, the entire contact force is made available. This has the advantage that, at least at the start of mating, the insertion force is reduced, and only after reaching an intermediate position in which the two mateable plug connection elements already undergo guidance as mating continues is a higher insertion force necessary. At the start of mating, the contact member can already also be in contact, optionally in electrical contact-making, but with the associated further plug connection element, the contact force is reduced due to the effectiveness of the clamping element.

In one embodiment, due to the clamping element which is active at the start of mating, between the contact member and the contact-making surface of the further plug connection element, there is a gap which can be closed by canceling the action of the clamping element. The gap can be, for example, less than 0.2 mm, especially less than 0.05 mm, and preferably less than 0.03 mm. In this way, at the start of mating, guidance is also already ensured between the two plug connection elements without the insertion force being increased by a contact of the contact member with the contact-making surface.

In one embodiment, the clamping element can be displaced in the plug connection element during mating, in particular can be displaced in the insertion direction. The displacement can take place only when the clamping element comes into preferably positive contact with a contact surface which is intended for this purpose in the further plug connection element, and the clamping element can thus be displaced in the insertion direction in further mating.

In one embodiment, a lubricant which reduces the friction force is applied between a base body of the plug connection element and the clamping element. For example, the clamping element and/or the base body on its corresponding surface can have a coating which reduces the friction force, and/or the clamping element can be oiled or greased. Alternatively or in addition, the clamping element, which in the mated state does not have a mechanical or electrically conductive function, can be produced from a material which has a low coefficient of friction matched to the material of the base body.

The two plug connection elements at the start of mating can be inserted into one another through the gap without force or even free of force until the further plug connection element comes into contact with the clamping element and pushes the latter in the course of further mating until the action of the clamping element is canceled.

In one embodiment, the clamping element is located in the plug connection element such that only after reaching more than 40% of the overlap of the contact surfaces of the plug connection element which are assigned to one another on the one hand and of the further plug connection element on the other hand, especially only after reaching more than 55% of the overlap and preferably only after reaching more than 65% of the overlap, the action of the clamping element can be canceled by the further mating. Thus an increased insertion force must be applied only for the remainder of the mating path. As a result, the abrasion on the surface of the contact member and/or the assigned contact surface of the other plug connection element is also reduced.

In one embodiment, the plug connection element is a socket element. The clamping element can be made as an expanding ring by means of which the contact member and/or a separate spring can be spread to an amount by which the force which is necessary for mating of the socket element with the plug element is reduced. For example, the inside width of the contact member of the socket element, under the action of the clamping element, can be greater than the outside diameter of a contact pin of the plug element.

In one embodiment, the plug connection element can be a plug element, and the clamping element can reduce the outside diameter of the contact member, for example, by a clamping ring which can be stripped off during mating, and in this way its action on the contact member can be canceled.

In one embodiment, the plug connection element and/or the further plug connection element has a fixing element with which the completely mated state of the plug connection element and the further plug connection element can be fixed. In this way, even when further compressive and especially tensile forces occur, it is ensured that the mated state and thus the electrical connection are maintained.

In one embodiment, when the plug connection element is mated with the further plug connection element, the fixing element can be elastically deformed. For example, the fixing element can be elastically deflected during mating. After reaching the mated position, the fixing element can lock into a latch recess provided for this purpose on the other plug connection element. The recess can be made such that the fixing can be neutralized only with a very high expenditure of force and/or with a tool. In one embodiment, the latch recess can also have a self-locking flank which prevents nondestructive cancelation of the mated state.

In one embodiment, the clamping element and the fixing element are located in the plug connection element and/or the further plug connection element such that the clamping element during mating is active until the fixing element has undergone more than 60%, especially more than 80%, and preferably more than 95% of its maximum deformation. In this way, in a first stage of mating only the fixing element can be deformed; this is possible with a comparatively small insertion force. Only when the fixing element has largely or even completely assumed its maximally deformed state, in a second stage of mating can the clamping element be displaced and/or can the action of the clamping element be canceled. This prevents the forces for deformation of the fixing element on the one hand and for displacing the clamping element on the other hand from adding up during mating.

In one embodiment, the plug connection element and/or the further plug connection element has a base body which has an opening for accommodating a conductor which can be electrically and mechanically connected to the base body by means of a clamping screw. The base body can also have several openings for screwing in several clamping screws. In one embodiment, the base body of the plug connection element and/or of the further plug connection element is cylindrical and/or without sharp edges on the surface, so that a socket insulating body, which is placed over the surface and which can be elastically stretched radially, is protected against damage. In one embodiment, the outside diameter of the base body should therefore not exceed a certain amount, for example, 37 mm.

Other advantages, features, and details of the invention will become apparent from the dependent claims and the following description in which several exemplary embodiments are detailed with reference to the drawings. In doing so, the features mentioned in the claims and in the description may be essential to the invention individually or in any combination.

Figure 2:
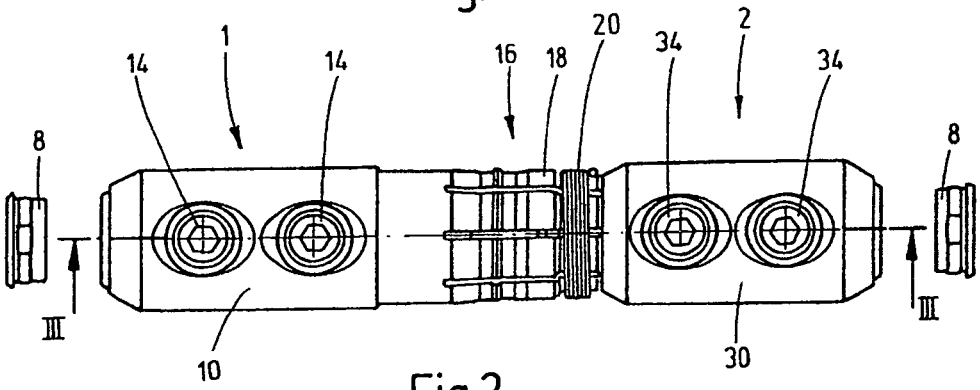
Figure 3:
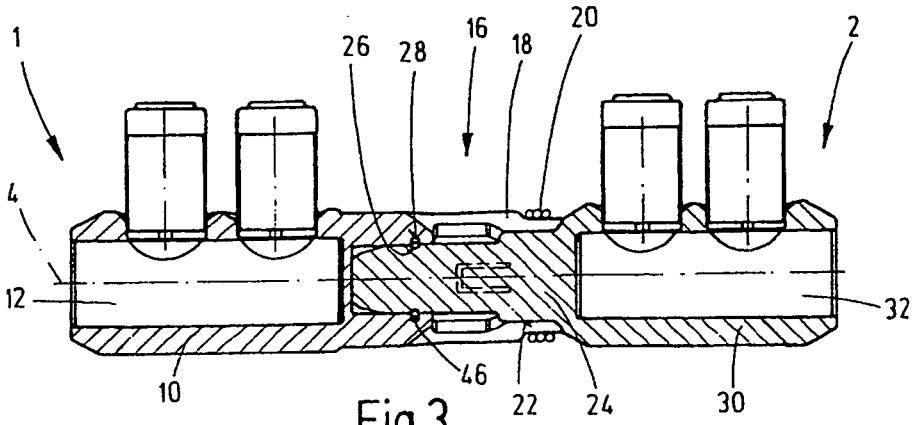
Figure 5:
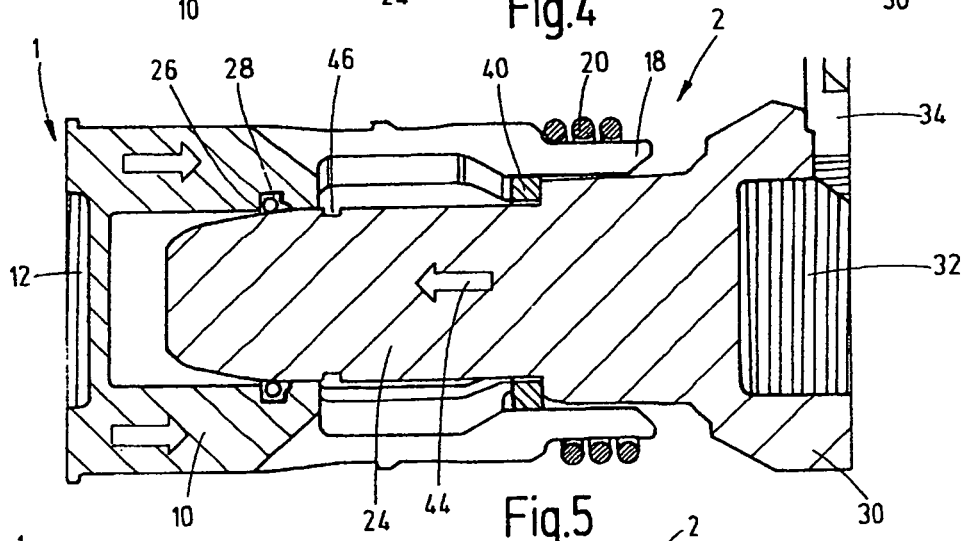
Figure 6:
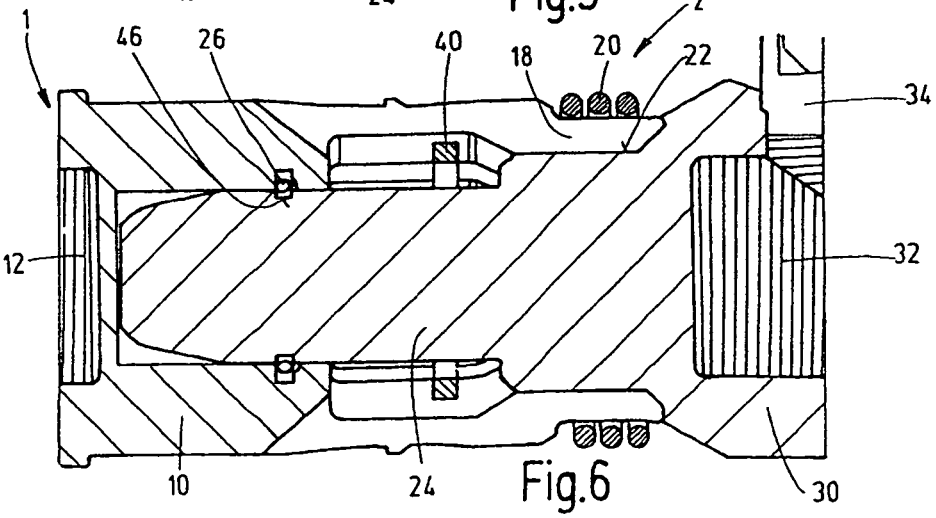
Figure 7:
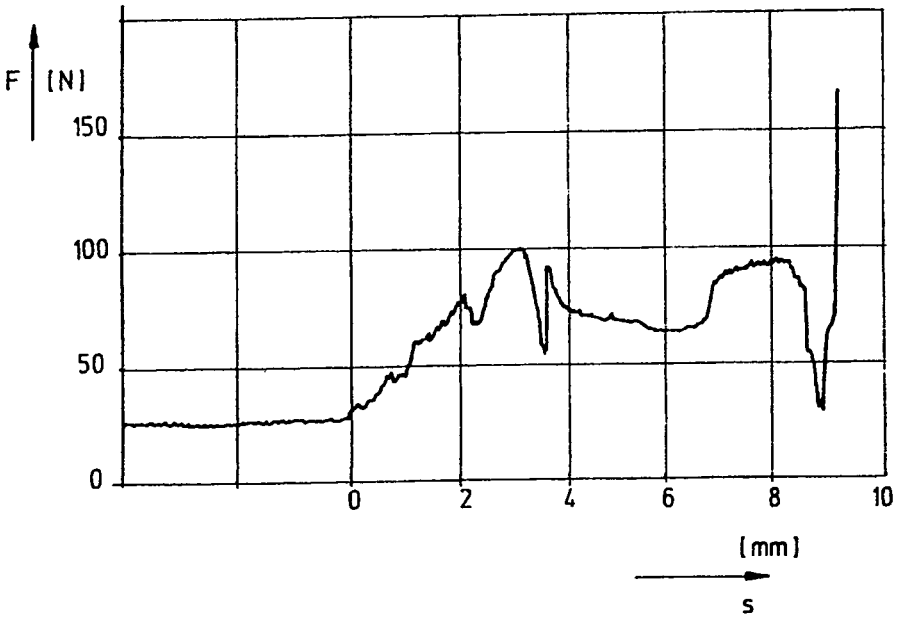

FIG. 1 shows a side view of one exemplary embodiment of an electrical plug connection element, FIG. 2 shows a plan view of the arrangement of FIG. 1, FIG. 3 shows a section through the arrangement of FIG. 2, FIGS. 4 to 6 show a cross section through the two plug connection elements in different stages of mating, and FIG. 7 shows the variation of the force F over the path s when the two plug connection elements are mated.

FIG. 1 shows a side view of one exemplary embodiment of an electrical plug connection element 1 in the completely mated state with a further plug connection element 2. FIG. 2 shows a plan view of the arrangement of FIG. 1. FIG. 3 shows a section III-III through the arrangement of FIG. 2.

The plug connection element 1 has a base body 10 which has an opening 12 for accommodating a conductor which is not shown. The conductor can be electrically and mechanically connected to the base body 10 by two clamping screws 14 which can be screwed in radially with respect to a longitudinal axis 4 of the plug connection element 1. The further plug connection element 2 likewise has an opening 32 for a conductor which is to be connected and which can be electrically and mechanically connected to the base body 30 of the further plug connection element 2 by means of clamping screws 34 which can be screwed in radially with reference to the longitudinal axis.

Cable conductors with different cross sections can be plugged in the openings 12, 32. In particular, for cable conductors with a conductor cross section that is smaller than the maximum possible, a centering ring 8 can be used, especially can be inserted into the opening 12, 32, which ring is assigned to the respective conductor cross section or optionally also matched to the respective conductor cross section. The centering ring 8 centers the cable conductor with reference to the opening 12, 32$\delta$ i.e., an offset of the longitudinal axis of the cable conductor relative to the longitudinal axis of the opening 12, 32 can be minimized or even eliminated. In the mounted state, the longitudinal axis of the cable conductor can thus coincide with the longitudinal axis of the opening 12, 32. The transverse offset of the cable with reference to the opening 12, 32 of the base body 10, 30 in the socket insulation body can thus be minimized or eliminated.

The longitudinal axis 4 of the electrical plug connection element 1 coincides with the longitudinal axis 6 of the further plug connection element 2 in the mated state. The insertion direction runs parallel to the longitudinal axis 4.

The base body 10 preferably integrally forms a contact member 16 which in the exemplary embodiment has contact blades 18 which are located around the longitudinal axis 4 and which can be deflected elastically in the radial direction. The contact member 16 forms a basket contact which in the exemplary embodiment has a total of six contact blades 18 which can be arranged equidistantly in the circumferential direction. To support the contact force, the plug connection element 1 has a separate spring 20 which in the exemplary embodiment as a wrap spring loops the contact blades 18 near their free axial end and pretensions them in the direction radially to the inside. In this way, in the mated state, the contact blades 18 are kept making contact with the contact-making surface 22 of a contact pin 24 of the further plug connection element 2. The base body 30 preferably forms the contact pin 24 in one piece.

In the completely mated state, a fixing element 26 which is made as a latching ring and which is inserted into an inner groove 28 in the base body 10 of the plug connection element 1 is locked into an outer groove 46 which runs on the contact pin 24. In this way, the completely mated state is safeguarded and can only be canceled, if at all, by an unduly high tensile force on the plug connection elements 1, 2.

Figure 4:
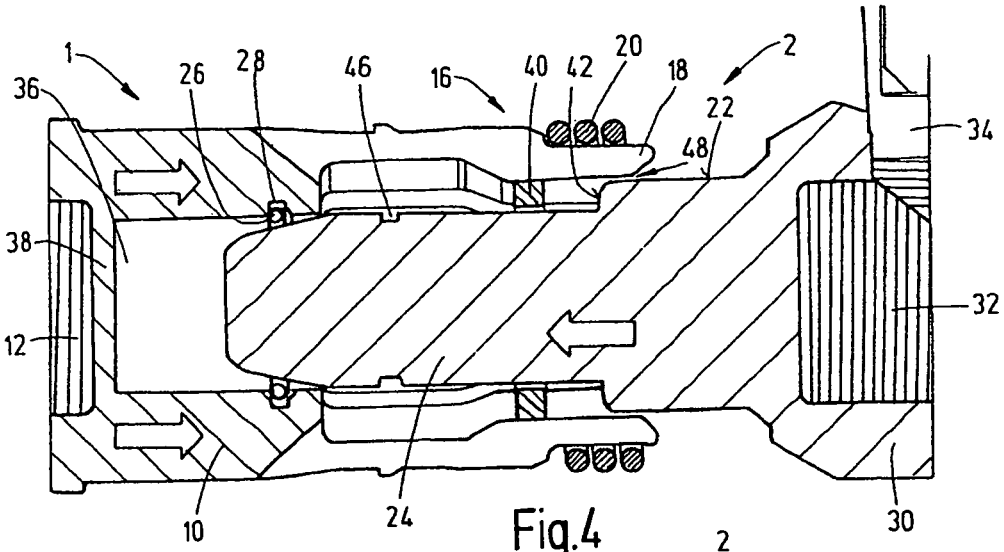

FIGS. 4 to 6 show a cross section through the two plug connection elements 1, 2 in different stages of mating. In the plug connection element 1, a clamping element 40 is in contact with the contact member 16, especially the contact blades 18, such that the contact blades 18 are bent radially to the outside against the force of the separate spring 20. In this way, the inside width of the circumference enclosed by the contact blades 18 is greater than or equal to the outside diameter of the contact pin 24 of the further plug connection element 2 in the region of the contact-making surface 22; and a ring-shaped gap 48 forms which can be less than 0.2 mm, especially less than 0.5 mm, and preferably less than 0.03 mm. The inside width in the state shown in FIG. 4 between 0.01 mm and 0.4 mm, especially between 0.01 mm and 0.1 mm, and preferably between 0.01 mm and 0.06 mm, can be greater than the outside diameter of the contact pin 24 in the region of the contact-making surface 22.

The inside diameter of the clamping element 40 can be greater than or equal to the outside diameter of one section of the contact pin 24 which is smaller than the outside diameter in the region of the contact-making surface 22. In this way, the two plug connection elements 1, 2 in the position shown in FIG. 4 can be mated without force or at least with only minimal force according to the arrows.

The base body 10 has an opening 36 whose inside width is greater than the end section of the contact pin 24 of the further plug connection element 2. The opening 36 is made as a blind hole opening and is separated from the opening 24 for inserting a conductor through a wall 38. In the region of the opening 36, which is cylindrical preferably at least in sections, the fixing element 26 is inserted in the inner groove 28 and initially is not yet in contact with the contact pin 24. The contact pin 24 is rounded on its axial end and/or has an at least partially conical section.

As mating continues (FIG. 5), the conical section of the contact pin 24 comes into contact with the fixing element 26 and spreads it in the course of mating. In the state shown in FIG. 5, the fixing element 26 is spread almost to the maximum degree. In this state, a ring-shaped shoulder 42 which is made by the contact pin 24 and which is formed by the transition to the contact-making surface 22 with its increased outside diameter comes into contact with the clamping element 40; when pushed further together, the clamping element 40 is displaced in the direction of the arrow 44 within the plug connection element 1. In the state shown in FIG. 5, the overlapping of the contact surfaces of the plug connection element 1 and of the further plug connection element 2, which surfaces are assigned to one another, is more than 40% of the overlapping in the completely mated state of FIG. 6, especially more than 55%, and preferably more than 65%.

The contact blades 18 have a section with a reduced wall thickness by which the inside width of the base body 10 in this region is increased. The transition to the increased inside width takes place at an obtuse angle of more than 90°, especially more than 120°, and preferably more than 145°. As soon as the clamping element 40 has been pushed into this section, the action of the clamping element 40 is canceled. This state is shown in FIG. 6. As a result, the contact blades 18 make contact with the surface 22, additionally supported by the separate spring 20. In the state shown in FIG. 6, the fixing element 26 moreover locks into the outer groove 46 of the contact pin 24 and in this way fixes the mated state.

FIG. 7 shows the variation of the force F in newtons over the path s in mm when the two plug connection elements 1, 2 are mated. The region $s<0$ corresponds to the mating stage until the conical end surface of the contact pin 24 comes into contact with the fixing element 26. In the region $0<s<$approx. 3 mm, mating spreads the fixing element until the shoulder 42 comes into contact with the clamping element 40. At approx. $s=3.5$ mm, upon continued mating, the displacement of the clamping element 40 begins until, at approx. $s=6.5$ mm, the action of the clamping element 40 is canceled and the contact blades 18 are in contact with the surface 22. In this way, the force which is necessary for the further mating increases, but overall remains below a value of approx. 100 N. At approx. $s=9$ mm, the fixing element 26 locks into the outer groove 46, whereupon the completely mated state is reached and the force increases very dramatically.

The diagram shows that during mating the stage in which the fixing element is spread ($0\leq s\leq$approx. 3 mm) and the stage in which the clamping element is being displaced (approx. 3.5 mm$<s<$approx. 6.5 mm), and/or the stage in which the contact blades 18 are in contact with the contact-making surface 22 (approx. 7 mm$<s<$approx. 9 mm) are clearly separated from one another so that the insertion forces which are necessary in the respective stages do not add up, but need only be applied in succession during mating.

The invention claimed is:

1. An electrical plug connection element (1) having an elastically deformable contact member (16) with which the plug connection element (1) can be electrically connected when mated with an associated further plug connection element (2), characterized in that the plug connection element (1) has a ring-shaped clamping element (40) by means of which the contact member (16) and/or a separate spring (20), which supports the contact member (16) when contact is made, can be elastically deformed such that the force which is necessary when the plug connection element (1) is mated with the further plug connection element (2) is reduced, wherein the further plug connection element comprises a contact pin portion and a ring-shaped shoulder portion, and that the action of the ring-shaped clamping element (40) can be canceled by mating the plug connection element (1) with the further plug connection element (2) and as a result the contact member (16) can be brought into electrically connecting contact with the further plug connection element (2) with the provided contact force, wherein, when the contact pin is pushed through the ring-shaped clamping element, the ring-shaped shoulder portion contacts the clamping element, and wherein when the contact pin is pushed further, the ring-shaped clamping element is displaced within the electrical plug connection element such that the ring-shaped clamping element no longer prevents the contact member from radial inward movement.

2. The plug connection element (1) according to claim 1, characterized in that due to the clamping element (40) which is active at the start of mating, there is a gap (48) between the contact member (16) and the contact-making surface (22) of the further plug connection element (2) and that the gap (48) can be closed by canceling the action of the clamping element (40).

3. The plug connection element (1) according to claim 1, characterized in that the clamping element (40) can be displaced in the plug connection element (1) during mating, especially can be displaced in the insertion direction.

4. The plug connection element (1) according to claim 1, characterized in that a lubricant which reduces the friction force is applied between a base body (10) of the plug connection element (1) and the clamping element (40).

5. The plug connection element (1) according to claim 1, characterized in that the clamping element (40) is located in the plug connection element (1) such that only after reaching more than 40% of the overlap of the contact surfaces of the plug connection element (1) which are assigned to one another and of the further plug connection element (2), especially only after reaching more than 55% of the overlap and preferably only after reaching more than 65% of the overlap, the action of the clamping element (40) can be canceled by the further mating.

6. The plug connection element (1) according to claim 1, characterized in that the plug connection element (1) is a socket element, and that the clamping element (40) is an expanding ring by means of which the contact member (16) of the socket element and/or the separate spring (20) can be spread to an amount by which the force which is necessary for mating with a plug element is reduced.

7. The plug connection element (1) according to claim 1, characterized in that the plug connection element (1) and/or the further plug connection element (2) has a fixing element (26) with which the mated state of the plug connection element (1) and further plug connection element (2) can be fixed.

8. The plug connection element (1) according to claim 7, characterized in that when the plug connection element (1) is mated with the further plug connection element (2), the fixing element (26) can be elastically deformed.

9. The plug connection element (1) according to claim 7, characterized in that the clamping element (40) and the fixing element (26) are located in the plug connection element (1) and/or the further plug connection element (2) such that the clamping element (40) during mating is active until the fixing element (26) has undergone more than 60%, especially more than 80%, and preferably more than 95% of its maximum deformation.

10. The plug connection element (1) according to claim 1, characterized in that the plug connection element (1) and/or the further plug connection element (2) has a base body (10,30) which has an opening (12,32) for accommodating a conductor which can be electrically and mechanically connected to the base body (10, 30) by means of a clamping screw (14, 34).

11. A connector assembly, comprising:

a first electrical plug connection element; and a second electrical plug connection element, wherein the first electrical plug connection element includes a radially deformable contact member formed on one end thereof, having an inner surface configured to electrically contact an outer surface of the second electrical plug connection element when inserted in the first electrical plug connection element, and further including a spring that surrounds an outer surface of the contact member, wherein the second electrical plug connection element comprises a contact pin portion and a ring shaped shoulder portion, wherein the first electrical plug connection element further includes a displaceable ring-shaped clamping element initially disposed at a first position within the contact member, wherein the clamping element is configured to prevent inward radial movement of the contact member when placed in the first position, wherein, when the contact pin is pushed through the clamping element, the ring-shaped shoulder portion contacts the clamping element, and wherein when the contact pin is pushed further, the shoulder portion laterally displaces the clamping element from its first position into a second position within first electrical plug connection element such that the clamping element no longer prevents the contact member from a radial inward movement, thereby allowing electrical contact of the inner surface of the contact member with an outer surface of the second plug connection element.

* * * * *

UNITED STATES PATENT AND TRADEMARK OFFICE

CERTIFICATE OF CORRECTION

PATENT NO. : 8,702,438 B2
APPLICATION NO. : 13/261521
DATED : April 22, 2014
INVENTOR(S) : Frank Erich It is certified that error appears in the above-identified patent and that said Letters Patent is hereby corrected as shown below:

In the Specification

Column 4
Line 21, After "section" insert -- III-III --.

Line 51, Delete "12, 32ö" and insert -- 12, 32 --, therefor.

Signed and Sealed this
Second Day of September, 2014

Michelle K. Lee

Michelle K. Lee
*Deputy Director of the United States Patent and Trademark Office*